US009407025B2

(12) United States Patent
Hashimoto

(10) Patent No.: US 9,407,025 B2
(45) Date of Patent: Aug. 2, 2016

(54) CONNECTOR

(71) Applicant: Sumitomo Wiring Systems, Ltd., Mie (JP)

(72) Inventor: Norihito Hashimoto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/624,629

(22) Filed: Feb. 18, 2015

(65) Prior Publication Data

US 2015/0263451 A1 Sep. 17, 2015

(30) Foreign Application Priority Data

Mar. 13, 2014 (JP) ..... 2014-050505

(51) Int. Cl.
*H01R 13/40* (2006.01)
*H01R 13/432* (2006.01)
*H01R 13/436* (2006.01)
*H01R 13/52* (2006.01)

(52) U.S. Cl.
CPC ..... *H01R 13/432* (2013.01); *H01R 13/4364* (2013.01); *H01R 13/5208* (2013.01)

(58) Field of Classification Search
CPC ..... H01R 13/4223
USPC ..... 439/595, 752.5
See application file for complete search history.

(56) References Cited

U.S. PATENT DOCUMENTS 5,226,839 A * 7/1993 Koumatsu ..... H01R 13/4223 439/595
5,928,034 A * 7/1999 Tabata ..... H01R 13/4365 439/595
6,159,047 A * 12/2000 Tanaka ..... H01R 13/4364 439/595
6,390,860 B2 * 5/2002 Shirouzu ..... 439/595
6,981,900 B2 * 1/2006 Sakurai ..... H01R 13/64 439/595
7,311,561 B2 * 12/2007 Anbo ..... H01R 4/185 439/752.5
8,388,388 B2 * 3/2013 Suzuki ..... H01R 13/113 439/752.5
8,678,866 B2 * 3/2014 Hiraishi ..... H01R 13/4365 439/595
2002/0076996 A1 * 6/2002 Murakami ..... H01R 13/4365 439/752.5
2013/0315662 A1 * 11/2013 Kida ..... F16B 17/002 403/280
2014/0127928 A1 * 5/2014 Kida ..... H01R 13/4223 439/345
2015/0263451 A1 * 9/2015 Hashimoto ..... H01R 13/432 439/353

FOREIGN PATENT DOCUMENTS

JP 2013-218902 10/2013

* cited by examiner

*Primary Examiner* — Neil Abrams

(74) *Attorney, Agent, or Firm* — Gerald E. Hespos; Michael J. Porco; Matthew T. Hespos

(57) ABSTRACT

In the process of inserting a terminal fitting (90) into a cavity (20) of a housing (10), a stabilizer (95) enters a guiding groove (31) and an inserting operation of the terminal fitting (90) is guided. The front end of the guiding groove (31) defines a closed end part (32). When a retainer (60) is mounted into the housing (10), locking portions (66) are inserted into communication holes (33) and locked to the closed end parts (32) of the guiding grooves (31), thereby preventing the retainer (60) from coming out of the housing (10).

6 Claims, 6 Drawing Sheets

CONNECTOR

BACKGROUND

1. Field of the Invention

The present invention relates to a connector.

2. Description of the Related Art

Japanese Unexamined Patent Publication No. 2013-218902 discloses a connector that has a housing with cavities, terminal fittings to be inserted into the respective cavities from behind and a retainer to be mounted into the housing from the front. A deflectable locking lance is provided at an inner wall of the cavity of the housing and a deflection space for the locking lance is open on the front surface of the housing. A guiding groove is provided on the inner surface of the lower wall of each cavity and extends in a front-back direction. Further, a forwardly open entrance groove is provided on a partition wall between the cavities and extends in the front-back direction of the housing. A lock receiving portion is provided at a position facing the entrance groove.

The terminal fitting includes a stabilizer projecting downwardly from the lower surface of a connecting portion. Further, the retainer includes a front wall for covering the front surface of the housing. Ribs project back from the rear surface of the front wall and retaining portions project back from the rear surface of the front wall and side by side with the ribs.

In the above configuration, the stabilizer enters the guiding groove to guide an inserting operation of the terminal fitting into the cavity of the housing. Further, the locking lance resiliently locks the connecting portion of the terminal fitting that has been inserted properly into the cavity and primarily prevents a movement of the terminal fitting out of the cavity. On the other hand, the retaining portions enter the deflection spaces for the locking lances when the retainer is mounted into the housing to restrict the deflection of the locking lances. In this way, the movement of the terminal fitting out of the cavity is prevented secondarily. Further, the ribs enter the entrance grooves when the retainer is mounted into the housing and locks on the ribs engage the lock receiving portions to prevent a movement of the retainer out of the housing.

The guiding grooves for guiding the insertion of the terminal fittings of the above-described conventional connector and the lock receiving portions for preventing the retainer from coming out are at different positions in the housing. Thus, the structure of a mold for forming the guiding grooves and the lock receiving portions may become complicated and there is difficulty molding small connectors.

The invention was completed based on the above situation and aims to provide a connector capable of preventing the complication of the structure of a mold and also dealing with small connectors.

SUMMARY OF THE INVENTION

The invention is directed to a connector comprising terminal fittings. Each terminal fitting has a stabilizer projecting in a direction intersecting a front-back direction. The connector also has a housing with cavities that extend in the front-back direction and into which the terminal fittings are inserted from behind. Rearwardly open guiding grooves are formed on partition walls between adjacent cavities and communicate with the cavities. The guiding grooves receive the stabilizers to guide insertion of the terminal fittings into the cavities. Communication holes are open on the front ends of the partition walls and communicate with the guiding grooves. The front ends of the guiding grooves are closed. A deflectable locking lance is provided at an inner wall of each cavity and resiliently locks the properly inserted terminal fitting for preventing the terminal fitting from coming out backward. Deflection spaces for the locking lances open forward. A retainer is mounted in the housing from the front and has retaining portions for restricting the deflection of the locking lances by entering the deflection spaces for the locking lances. Locks of the retainer enter the communication holes and lock to the closed end parts of the guiding grooves to prevent the retainer from coming out of the housing.

The guiding grooves of the housing guide insertion of the terminal fittings and also have the closed front ends that engage the locks of the retainer to prevent the retainer from coming out of the housing. Thus, the structure of the housing can be simplified as compared with a conventional case where a structure for guiding terminal fittings and a structure locking a retainer are at different positions in a housing. As a result, the mold can be less complex and small connectors can be dealt with.

A rubber plug is fit externally on an end part of a wire and is fixed to a rear part of the terminal fitting. A rear part of the cavity has a larger diameter than a front part and defines a rubber plug accommodating portion for receiving the rubber plug in a liquid-tight manner when the terminal fitting is inserted properly in the cavity. The guiding groove communicates with only the front part of the cavity and is in a range to be accommodated in the width of the rubber plug accommodating portion when viewed from behind. Accordingly, the width of the housing is not increased due to the guiding grooves and the connector can be miniaturized.

DETAILED DESCRIPTION

An embodiment of the invention is described with reference to FIGS. 1 to 6. A connector of this embodiment includes a housing 10 made of synthetic resin, a retainer 60 made of synthetic resin and terminal fittings 90 made of electrically conductive metal. The housing 10 is connectable to an unillustrated mating housing. In the following description, an end where the mating housing is located with respect to the housing 10 at the start of connection is referred to as a front end concerning a front-back direction and a vertical direction is based on FIGS. 3 to 5. Further, a width direction is synonymous with a lateral direction of FIG. 5 in the following description.

Figure 5:
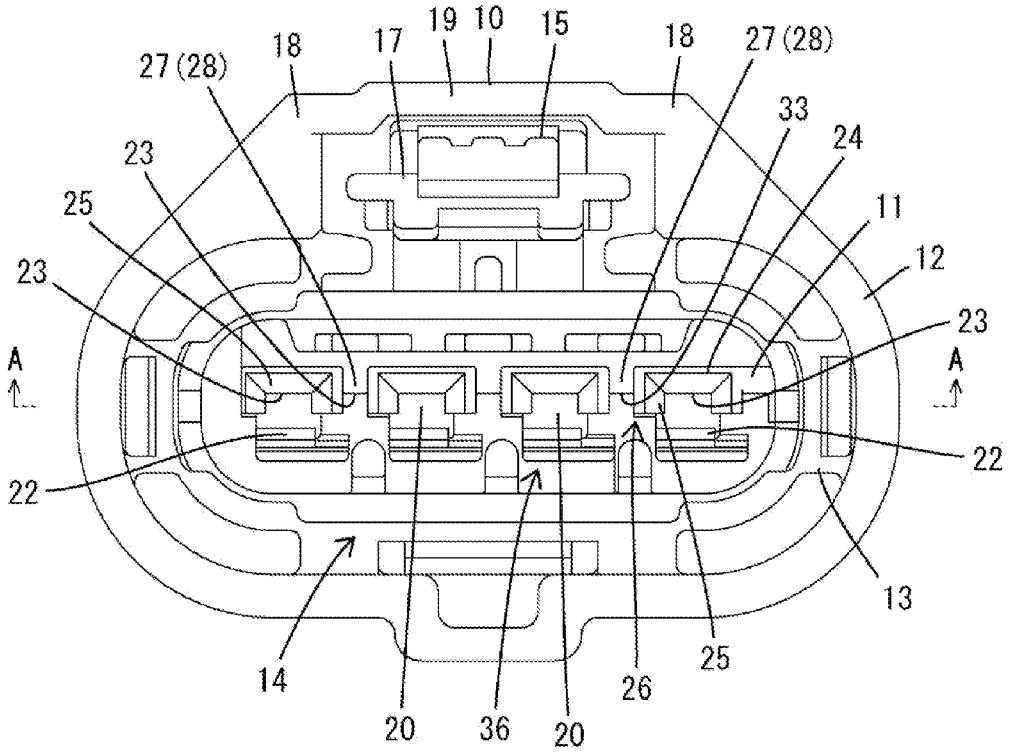
FIG. 5 is a front view of the housing.
Figure 6:
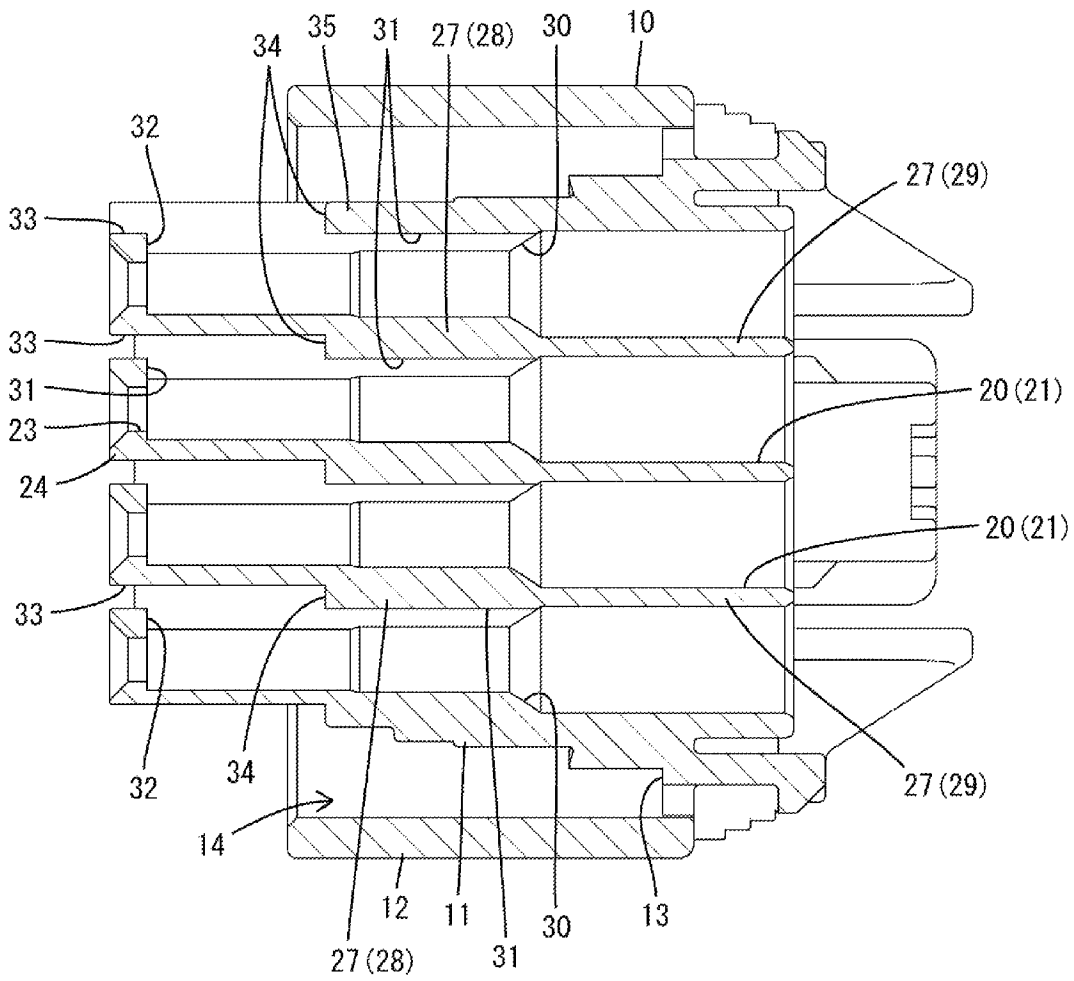
FIG. 6 is a section along A-A of FIG. 5.

As shown in FIGS. 5 and 6, the housing 10 includes a housing main body 11 in the form of a flat block in the width direction, a tubular fitting tube 12 surrounds the housing main body 11 and a radially extending coupling 13 connects the fitting tube 12 and the housing main body 11. A connection space 14 is open between the housing main body 11 and the fitting tube 12 before the coupling 13 to accommodate an unillustrated receptacle of the mating housing. A front part of the housing main body 11 projects farther forward than the front end of the fitting tube 12.

Figure 3:
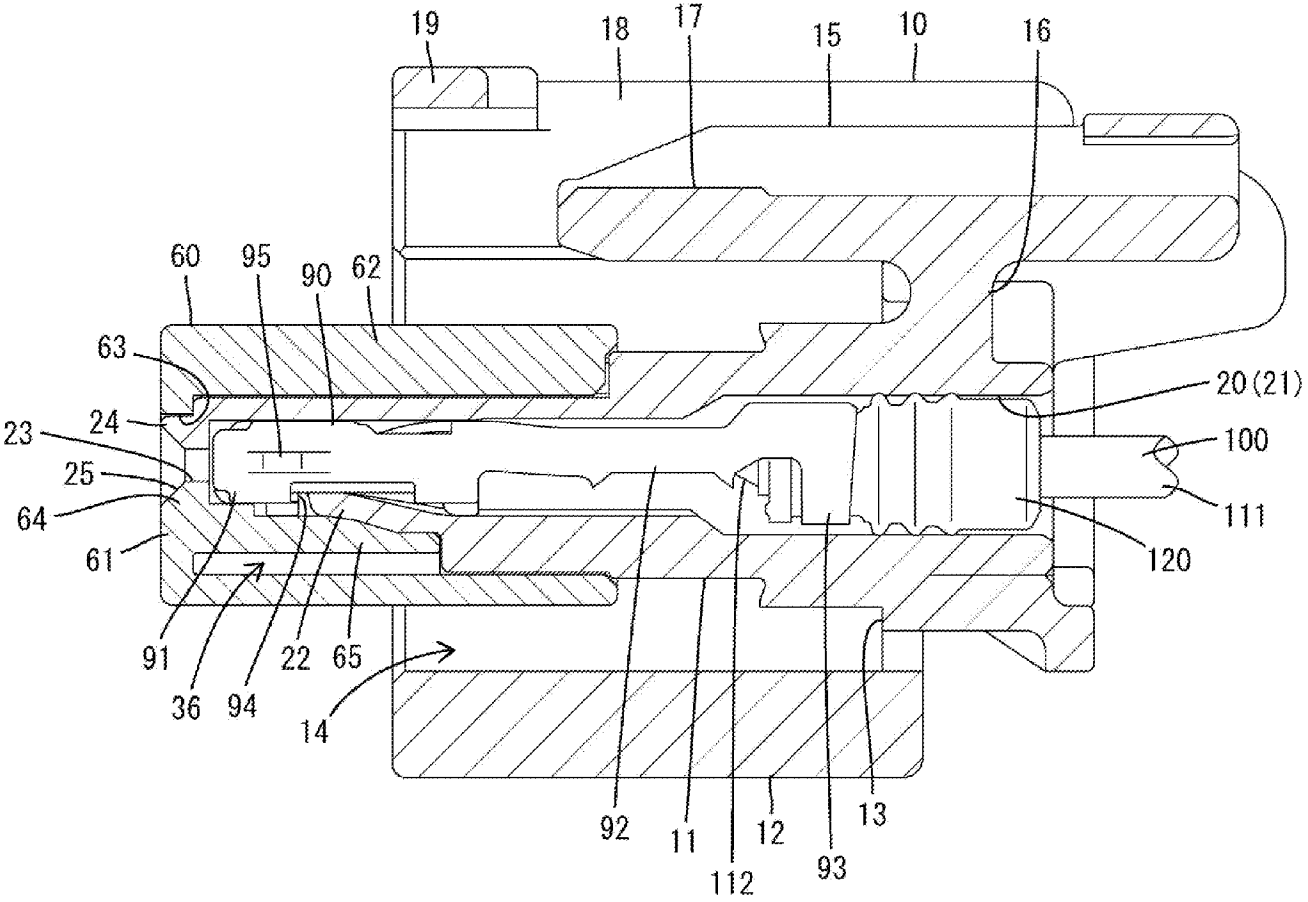
FIG. 3 is a side view in section showing the retainer at the full locking position.

The housing 10 includes a lock arm 15. As shown in FIG. 3, the lock arm 15 has a leg 16 that stands up from a rear part of the upper surface of the housing main body 11 and an arm main body 17 that extends both forward and backward from the upper end of the leg 16. The arm main body 17 can make a seesaw-like resilient pivotal displacement with the leg 16 as a support. The arm main body 17 locks an unillustrated lock portion of the mating housing when the housing 10 is connected properly to the mating housing to hold the two housings in a connected state.

As shown in FIG. 5, two protection walls 18 are provided at opposite widthwise sides of the lock arm 15 on the top of the fitting tube 12 and a bridging wall 19 connects the front ends of the protection walls 18 at positions before the lock arm 15. The upper surfaces of the lock arm 15 is exposed between the protection walls 18 and behind the bridging wall 19.

Cavities 20 penetrate the housing main body 11 in the front-back direction, as shown in FIG. 6, and are arranged side by side in a row in the width direction. A rubber plug accommodating portion 21 is formed at a rear part of each cavity 20 and has a circular cross-section that is wider than a front part of the cavity 20. The front part of each cavity 20 has a substantially rectangular cross-section. As shown in FIG. 3, a deflectable locking lance 22 is cantilevered obliquely forward from the lower surface of the inner wall of the front part of the cavity 20. An area of the housing main body 11 before the locking lances 22 is open as a mold removal space 26.

Figure 1:
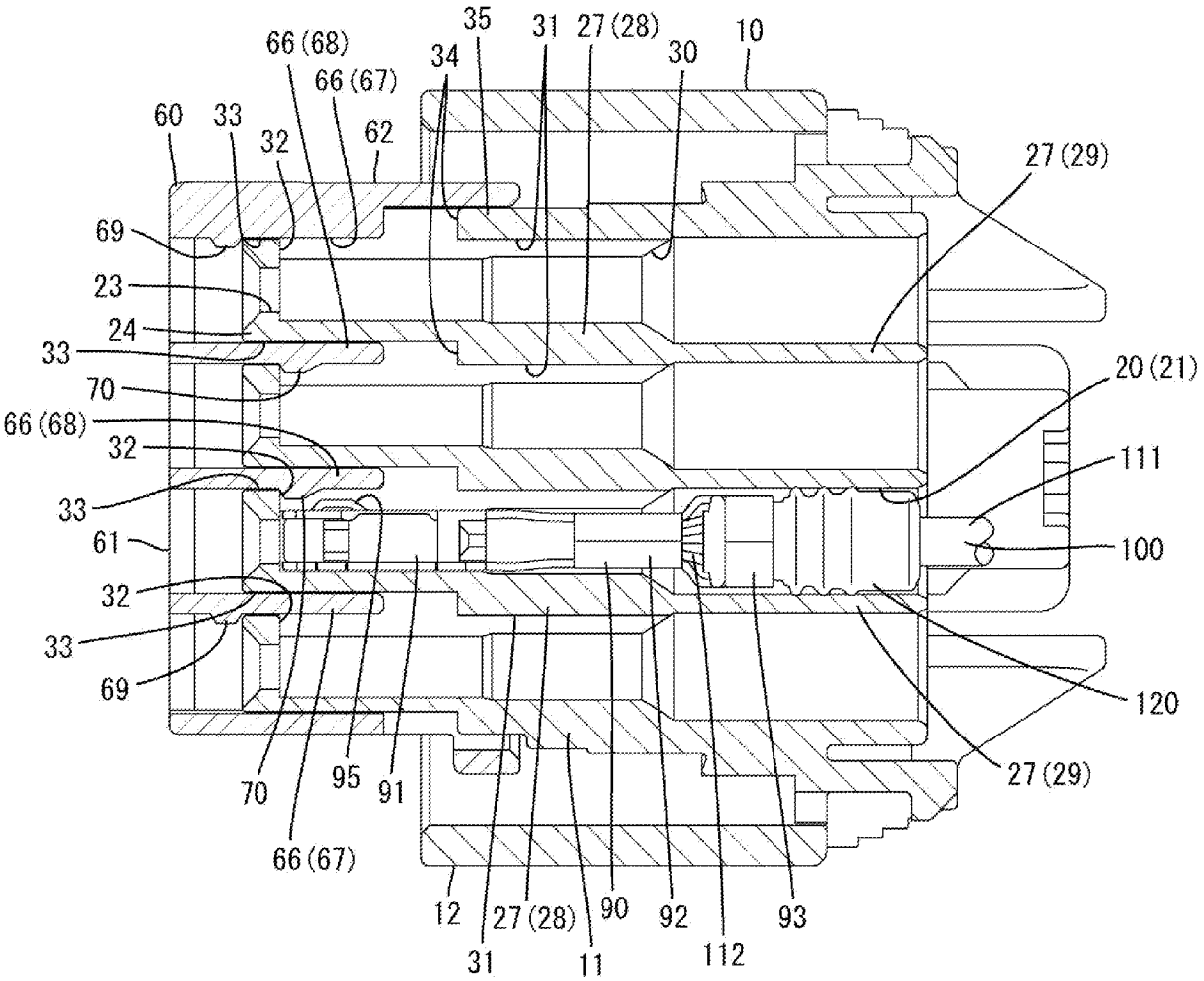
FIG. 1 is a plan view in section of a connector of an embodiment of the invention where a retainer is held at a partial locking position with respect to a housing.

The terminal fitting 90 is inserted into the cavity 20 of the housing main body 11 from behind and is locked resiliently by the locking lance 22 to be held and retained in the cavity 20 when inserted properly. As shown in FIGS. 1 and 3, the terminal fitting 90 includes a rectangular tubular main body 91, a wire barrel 92 connected to and behind the main body 91 and an insulation barrel 93 connected to and behind the wire barrel 92. The main body 91 receives a male tab of an unillustrated mating terminal fitting mounted in the mating housing and is connected electrically conductively to the mating terminal fitting when the housing 10 is connected properly to the mating housing.

As shown in FIG. 3, a stepped lance receiving portion 94 is provided at the lower wall of the main body portion 91 and can lock the locking lance 22 when the terminal fitting 90 is inserted properly. Further, as shown in FIG. 1, a laterally projecting stabilizer 95 is cut and bent on one side wall of the main body portion 91. The stabilizer 95 has a substantially rectangular cross-section when viewed from the front (see FIG. 4).

As shown in FIGS. 1 and 3, the wire barrel 92 is connected by crimping to a core 112 exposed by removing a coating 111 at an end part of the wire 100. The insulation barrel 93 is connected by crimping to a rubber plug 120 fit externally on the coating 111 at the end part of the wire 100.

As shown in FIGS. 1 and 3, the rubber plug 120 has a cylindrical shape with an outer diameter slightly larger than the main body portion 91. The inner peripheral surface of the rubber plug 120 is held resiliently in close contact with the outer peripheral surface of the coating 111 of the wire 100 and the rubber plug 120 is inserted into the rubber plug accommodating portion 21 so that the outer peripheral surface thereof is held resiliently in close contact with the inner peripheral surface of the rubber plug accommodating portion 21 when the terminal fitting 90 is inserted properly into the cavity 20. In this way, the housing main body 11 and the wire 100 are sealed in a liquid-tight manner. Note that an unillustrated seal ring is fit externally on the outer peripheral surface of the housing main body 11. When the housings are connected properly, the seal ring is sandwiched resiliently between the receptacle of the mating housing and the housing main body 11 to provide liquid tight sealing between the housings. The seal ring contacts a peripheral plate 62 of the retainer 60 to prevent the retainer 60 from coming out forward when the retainer 60 is at a full locking position.

As shown in FIG. 5, front walls 24 are provided on the front of the housing main body 11. Each front wall 24 has a U-shaped cross-section and closes an upper part of a front opening of the corresponding cavity 20 while leaving a tab insertion path 23, into which the male tab of the unillustrated mating terminal fitting is inserted. A tapered guiding surface 25 is provided around the tab insertion path 23 on the front surface of the front wall 24 for guiding the mating tab into the cavity 20. A lower part of the front of each cavity 20 is open and communicates with the mold removal space 26.

Partition walls 27 are provided in the housing main body 11 between adjacent cavities 20, as shown in FIG. 6. The partition walls include front partition walls 28 in the front parts of the respective cavities 20 and rear partition walls 29 in rear parts of the cavities 20. The front partition walls 28 are thicker than the rear partition walls 29 at central positions of the cavities 20 in a height direction. As shown in FIG. 5, a front part of the front partition wall 28 constitutes a side part of the front wall 24 and defines the upper edge of the mold removal space 26.

Figure 4:
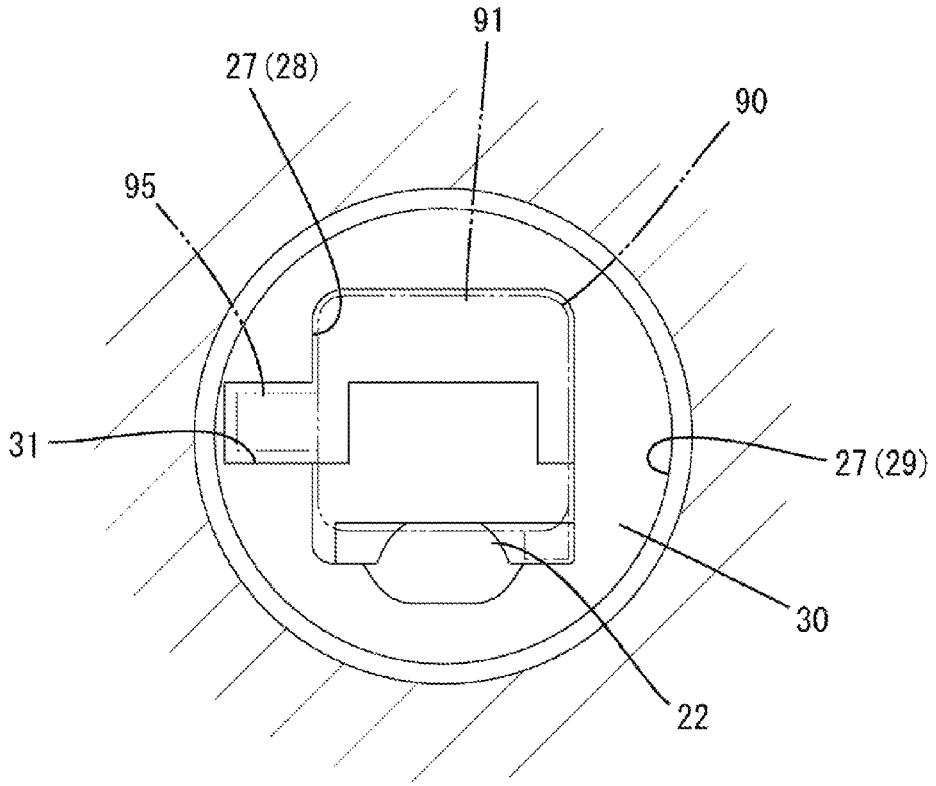
FIG. 4 is a rear view in section of a cavity part of the housing.

A tapered surface 30 is formed on a rear part of each front partition wall 28 and gradually narrows the cavity 20 from the front end of the rear partition wall 29 toward the front, as shown in FIG. 6. A guiding groove 31 is provided on one side surface of each front partition wall 28 and communicates with a central part of the cavity 20 in the height direction. Each guiding groove 31 extends in the front-back direction and has a rear end that is open on the tapered surface 30 and a front end that is closed as a closed end part 32 at a position near the front end of the housing main body 11. The guiding groove 31 is not formed in the rubber plug accommodating portion 21 and has a depth to be accommodated within the width of the rubber plug accommodating portion 21 when viewed from behind, as shown in FIG. 4. The guiding groove 31 has a substantially rectangular cross-section and the stabilizer 95 of the terminal fitting 90 can be fit and inserted therein from behind. As shown in FIG. 6, the closed end part 32 of the guiding groove 31 is a flat surface extending in the width direction.

A communication hole 33 extends in the front-back direction on each front partition wall 28 and communicates with the mold removal space 26, as shown in FIGS. 5 and 6. Each communication hole 33 has an open front end on the front surface of the front wall 24. Additionally, each communication hole 33 communicates in parallel with the guiding groove 31 from a position corresponding to the closed end 32 of the guiding groove 31 to the rear end and has a rear end closed as a stop 34. A front surface opening of the communication hole 33 is between the guiding surfaces 25 of adjacent front walls 24. The stop 34 of the communication hole 33 is a flat end surface extending in the width direction. As shown in FIG. 6, the communication hole 33 and the guiding groove 31 also are formed on one of the outer side walls 35 in the same manner as those provided on the partition walls 27. Of course, the communication hole 33 on the outer side wall 35 is exposed on the outer surface of the housing main body 11 and a rear end thereof is arranged to face the connection space 14.

As shown in FIGS. 1 and 3, the retainer 60 is mounted into the housing main body 11 from the front and includes a plate-like front plate 61 extending in the width direction and a peripheral plate 62 projecting back from the outer periphery of the front plate 61. The retainer 60 is movable in the front-back direction between a partial locking position (see FIG. 1) where the front plate 61 is separated forward from the front surfaces of the front walls 24 of the housing main body 11 and the full locking position (see FIGS. 2 and 3) where the front plate 61 is in contact with the front surfaces of the front walls 24 of the housing main body 11 to cover these front surfaces.

As shown in FIG. 3, fitting holes 63 penetrate through the front plate 61 and can receive the front walls 24 at the full locking position. Additionally, protecting plates 64 close the front surface openings of the mold removal space 26 and cover the locking lances 22 from front. The protecting plates 64 are arranged below the front walls 24 to face the front walls 24 and define the tab insertion paths 23 together with the front walls 24. A tapered guiding surface 25 is continuous with the front wall 24 and is provided around the tab insertion path 23 on the front surface of the protecting plate 64.

Retaining portions 65 project from the rear surfaces of the protecting plates 64 of the front plate 61 at positions corresponding to the respective cavities 20 of the housing main body 11. Each retaining portion 65 is retracted to a position to allow the deflection of the locking lance 22 at the partial locking position and is inserted deeply into the deflection space 36 for the locking lance 22 (see FIG. 5) at the full locking position as shown in FIG. 3 to restrict deflection of the locking lance 22.

Figure 2:
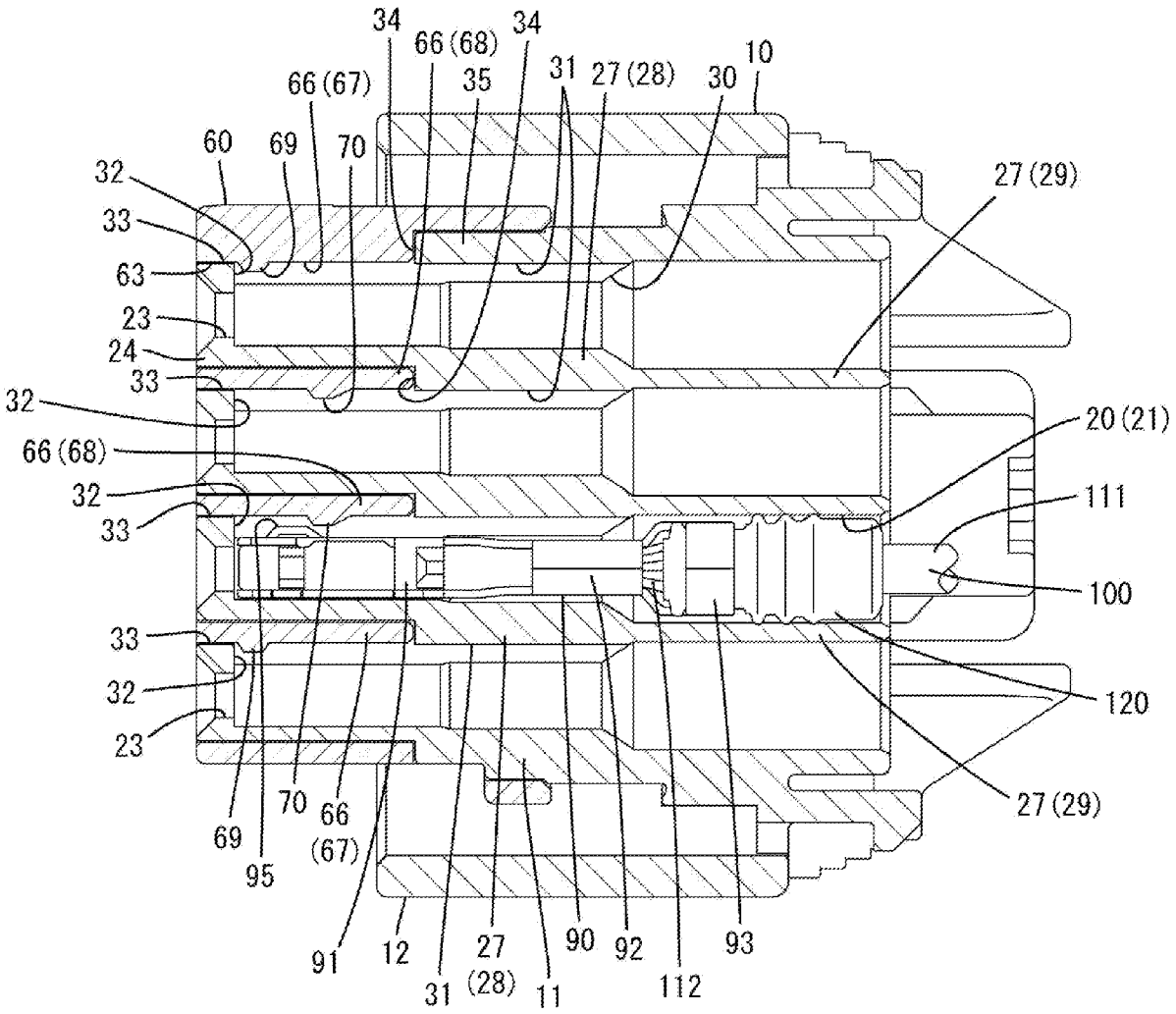
FIG. 2 is a plan view in section showing the retainer at a full locking position in the housing.

Locking portions 66 project on the rear surface of the front plate 61 at positions corresponding to the respective partition walls 27 and the one outer side wall 35 of the housing main body 11, as shown in FIGS. 1 and 2. Each locking portion 66 is in a plate that can fit into the communication hole 33. The locking portion 66 corresponding to the one outer side wall 35 is coupled unitarily to the peripheral plate 62.

As shown in FIGS. 1 and 2, the locking portions 66 include two full locking portions 67 coupled to the peripheral plate 62 and arranged on opposite widthwise ends and two partial locking portions 68 arranged in a widthwise middle part between the full locking portions 67. Each full locking portion 67 includes a full locking projection 69 at a position near a front end on a surface facing the guiding groove 31 in a state inserted in the communication hole 33. On the other hand, the partial locking portion 68 includes a partial locking projection 70 closer to a rear end than the full locking projection 69 on a surface facing the guiding groove 31 in a state inserted in the communication hole 33.

The partial locking projections 70 are slightly longer in the front-back direction than the full locking projections 69. Further, front and rear surfaces of both the partial locking projections 70 and the full locking projections 69 are tapered inclined surfaces. The front inclined surfaces of the full locking projections 69 have a steeper angle of inclination than the front inclined surfaces of the partial locking projections 70, and the rear inclined surfaces of the full locking projections 69 and those of the partial locking projections 70 have substantially the same angle of inclination.

As shown in FIG. 1, the retainer 60 initially is held at the partial locking position with respect to the housing 10. At the partial locking position, rear ends of the full locking portions 67 are inserted into the communication holes 33 on the opposite widthwise end parts of the housing main body 11 from the front and the full locking projections 69 of the full locking portions 67 are in contact with the front surfaces of the front walls 24 of the housing main body 11 to be lockable. Further, at the partial locking position, rear ends of the partial locking portions 68 are inserted into the communication holes 33 in the widthwise middle part of the housing main body 11 from the front and the partial locking projections 70 of the partial locking portions 68 enter the guiding grooves 31 after being slightly press-fit into the communication holes 33 of the front wall portions 24 and are arranged to contact the closed ends 32 of the guiding grooves 31 to be lockable. In this way, the retainer 60 is held at the partial locking position with a movement in the front-back direction restricted.

The terminal fittings 90 are inserted into the cavities 20 of the housing 10 from behind with the retainer 60 at the partial locking position. The stabilizer 95 enters the guiding groove 31 during the insertion and slides on a groove surface of the guiding groove 31 to guide the insertion of the terminal fitting 90. The stabilizer 95 cannot enter the guiding groove 31 and will interfere with the tapered surface 30, if the terminal fitting 90 is not in the proper posture, such as a vertically inverted posture, thereby preventing further insertion of the improperly oriented terminal fitting 90 into the cavity 20. On the other hand, the properly oriented terminal fitting 90 can be inserted into the cavity 20 so that the locking lance 22 is locked resiliently to the lance receiving portion 94 of the main body 91 to hold the terminal fitting 90 in the cavity 20 of the housing 10.

The retainer 60 subsequently is pushed to the full locking position. At this time, the locked state of the full locking projections 69 of the full locking portions 67 and the front surfaces of the front walls 24 is released by a pushing force for pushing the retainer 60 to the full locking position. As shown in FIG. 2, when the retainer 60 reaches the full locking position, the locking projections 66 are inserted deeply into the communication holes 33 and the rear ends thereof are arranged to contact the stops 34 of the communication holes 33. Further, at the full locking position, the full locking projections 69 pass through the communication holes 33 of the front walls 24, enter the guiding grooves 31 and contact the closed end parts 32 of the guiding grooves 31. In this way, the retainer 60 is held at the full locking position with movement in the front-back direction restricted. Further, when the retainer 60 reaches the full locking position, as shown in FIG. 3, the retaining portions 65 enter the deflection spaces 36 for the locking lances 22 and contact the lower surfaces of the locking lances 22. In this way, the locking lances 22 cannot deflect so that the terminal fittings 90 are retained secondarily in the cavities 20 of the housing 10.

The communication holes 33 are formed by pin-like mold parts to be pulled out forward. On the other hand, the guiding grooves 31 are formed together with the cavities 20 and the like by pin-like mold parts to be pulled out backward. In the case of this embodiment, the closed end parts 32 of the guiding grooves 31 function as a retaining structure for preventing the retainer 60 from coming out forward from the housing main body 11 by locking the partial locking projections 70 of the partial locking portions 68 and the full locking projections 69 of the full locking portions 67. A dedicated retaining structure for preventing the retainer 60 from coming out forward could be provided instead of the closed end parts 32 of the guiding grooves 31. However, a mold part for forming that dedicated retaining structure would have to be provided separately from a mold part for forming the guiding grooves 31, thereby making a mold structure complicated. In contrast, the retaining structure can be formed by the mold part for molding the guiding grooves 31 so that the mold structure is less complicated. As a result, it becomes possible to deal with the miniaturization of the connector.

The guiding groove 31 communicates only with the front part of the cavity 20 and is formed in such a range as to be accommodated within the width of the rubber plug accommodating portion 21 when viewed from behind, as shown in FIG. 4. Thus, the width of the housing 10 does not become particularly large due to the guiding grooves 31 and the connector can be miniaturized.

The invention is not limited to the above described embodiment. For example, the following embodiments also are included in the scope of the invention.

When the retainer is at one of the partial and full locking positions, either the partial locking portions or the full locking projections may lock the closed ends of the guiding grooves to prevent the retainer from coming out of the housing.

The invention is also applicable to non-waterproof connectors in which a terminal fitting is not fixed to a rubber plug externally fitted on an end part of a wire.

LIST OF REFERENCE SIGNS

10 . . . housing
20 . . . cavity
21 . . . rubber plug accommodating portion
22 . . . locking lance
27 . . . partition wall
31 . . . guiding groove
32 . . . closed end part
33 . . . communication hole
36 . . . deflection space
60 . . . retainer
61 . . . front plate portion
65 . . . retaining portion
66 . . . locking portion
67 . . . full locking portion
68 . . . partial locking portion
90 . . . terminal fitting
95 . . . stabilizer
100 . . . wire
120 . . . rubber plug

What is claimed is:

1. A connector, comprising:

terminal fittings each including a stabilizer projecting in a direction intersecting a front-back direction;

a housing with cavities extending in the front-back direction and into which the terminal fittings are inserted from behind, guiding grooves formed on partition walls between adjacent ones of the cavities, the guiding grooves communicating with the cavities and guiding insertion of the terminal fittings by having the stabilizers inserted therein from behind, and communication holes formed on the partition walls and communicating with the guiding grooves, the communication holes being open on front ends of the partition walls, front ends of the guiding grooves being closed as closed end parts, a deflectable locking lance provided at an inner wall of each cavity and locking the terminal fitting properly inserted into the cavity for preventing the terminal fitting from coming out backward, and forwardly open deflection spaces for the locking lances; and a retainer mounted into the housing from the front and including retaining portions for restricting the deflection of the locking lances locking the terminal fittings by entering the deflection spaces for the locking lances, and locking portions for preventing the retainer from coming out of the housing by being inserted into the communication holes and locked to the closed end parts of the guiding grooves.

2. The connector of claim 1, further comprising:

a rubber plug fit externally on an end part of a wire fixed to a rear part of the terminal fitting, and a rear part of the cavity has a larger diameter than a front part and is formed as a rubber plug accommodating portion in which the rubber plug is accommodated in a liquid-tight manner in a state where the terminal fitting is properly inserted in the cavity; and the guiding groove communicates with only the front part of the cavity and is arranged in such a range as to be accommodated within the width of the rubber plug accommodating portion when viewed from behind.

3. A connector, comprising:

a housing with opposite front and rear ends, cavities penetrating through the housing from the front end to the rear end, partition walls between adjacent ones of the cavities, guiding grooves formed on the partition walls and opening into a first side of each of the cavities, each of the guiding grooves extending from the rear end of the housing to a rearward facing closed end rearward of the front end of the housing, communication holes formed on each of the partition walls and opening into a second side of the each of the cavities opposite the first side, the communication holes extending from the front end of the housing to a forwardly facing stop forward of the rear end of the housing, the communication holes communicating with the guiding grooves at positions between the closed end of the guiding groove and the stop of the communication hole, a deflectable locking lance provided at an inner wall of each cavity, and forwardly open deflection spaces adjacent the locking lances; and a retainer mounted to the front end of the housing and including retaining portions for entering the deflection spaces and restricting deflection of the locking lances, and locking portions inserted into the communication holes and locked to the closed ends of the guiding grooves for preventing the retainer from coming out of the housing.

4. The connector of claim 3, wherein at least a first of the locking portions includes a partial locking projection disposed and configured for engaging the closed end of the guiding groove when the retainer is at a partial locking position where the retaining portions are spaced from the deflection spaces and at least a second of the locking portions includes a full locking projection disposed and configured for contacting the front end of the housing when the retainer is at the partial locking position.

5. The connector of claim 4, wherein full locking projection contact the closed end of the guiding groove for holding the retainer at a full locking position where the retaining portions are in the deflection spaces.

6. The connector of claim 3, further comprising terminal fittings each including a stabilizer slidably engageable in the guiding groove.

* * * * *